United States Patent [19]

Hinata et al.

[11] 3,951,666

[45] Apr. 20, 1976

[54] SPECTRALLY SENSITIZED SILVER HALIDE PHOTOGRAPHIC EMULSION

[75] Inventors: Masanao Hinata; Masanaga Ohki; Haruo Takei; Akira Sato; Tadashi Ikeda, all of Minami-ashigara, Japan

[73] Assignee: Fuji Photo Film Co., Ltd., Minami-ashigara, Japan

[22] Filed: Aug. 6, 1974

[21] Appl. No.: 495,171

[30] Foreign Application Priority Data

Aug. 6, 1973 Japan ..... 48-88196

[52] U.S. Cl. ..... 96/126; 96/137; 96/139; 96/140

[51] Int. Cl.[2] ..... G03C 1/14

[58] Field of Search ..... 96/126, 137, 139, 140

[56] References Cited

UNITED STATES PATENTS

| | | | |
|---|---|---|---|
| 2,977,229 | 3/1961 | Jones | 96/126 |
| 3,671,260 | 6/1972 | Oftedahl et al. | 96/126 |
| 3,759,713 | 9/1973 | Florens et al. | 96/126 |
| 3,837,862 | 9/1974 | Shiba et al. | 96/126 |

*Primary Examiner*—J. Travis Brown

*Attorney, Agent, or Firm*—Sughrue, Rothwell, Mion, Zinn & Macpeak

[57] ABSTRACT

A silver halide photographic emulsion containing a supersensitizing amount of the combination of at least one dye represented by the general formula (I)

(I)

wherein Z represents the non-metal atoms necessary to form a benzene nucleus; $R_0$, $R_1$ and $R_2$ each represents aliphatic groups, with at least one of $R_1$ and $R_2$ representing an alkyl group containing a carboxy group or an alkyl group containing a sulfo group; Y represents a halogen atom; X represents an acid anion; *n* represents an integer of 1 to 2, with *n* being 1 when the dye forms an intramolecular salt; and at least one dye represented by the general formula (II)

(II)

wherein $Z_1$ represents the non-metal atoms necessary to form a 5-or 6-membered heterocyclic nucleus; Q represents the atoms necessary to form a rhodanine nucleus, a 2-thio-2,4-imidazolidinedione nucleus, a 2-pyrazoline-5-one nucleus, or a 2-thio-2,4-oxazolidinedione nucleus; $R_3$ represents an aliphatic group; $R_4$ represents a hydrogen atom, an alkyl group, an alkoxy group, or a mono-aryl group; m represents 1 or 2; and p represents 1 or 2.

6 Claims, 3 Drawing Figures

SPECTRALLY SENSITIZED SILVER HALIDE PHOTOGRAPHIC EMULSION

BACKGROUND OF THE INVENTION

1. Field of the Invention

The present invention relates to a spectrally sensitized silver halide photographic emulsion and, more particularly, to a silver halide photographic emulsion which is supersensitized using the combination of two kinds of sensitizing dyes.

2. Description of the Prior Art

It is well known that the photosensitive wave length range can be extended to a longer wave length side by adding a certain cyanine dye to a silver halide photographic emulsion, i.e., a spectrally sensitized silver halide photographic photosensitive member.

The spectral sensitivity is influenced by the chemical structure of the sensitizing dye and the properties of the emulsion such as the halogen composition, crystal property, crystal system, silver ion concentration, and hydrogen ion concentration of the silver halide, etc. Moreover, the spectral sensitivity is influenced by photographic additives such as stabilizers, antifogging agents, auxiliary coating agents, precipitating agents, color couplers and the like which are present in the emulsion.

In general, a single sensitizing dye is used in sensitizing the predetermined spectral wave length range of a photosensitive member. When sensitizing dyes are used in combination with each other, a spectral sensitivity often is obtained which is lower than that obtained using the sensitizing dyes alone. In some specific cases, however, when a specific sensitizing dye is used in combination with a specific sensitizing dye, the sensitization is increased not additively, but "superadditively". This phenomenon is known as "supersensitization". A considerable selectivity is required in combining sensitizing dyes for obtaining supersensitization. An apparently slight difference in the chemical structure markedly influences the superadditivity and thus the combination of sensitizing dyes which exhibit superadditivity is difficult to predict from the chemical structures of the sensitizing dyes.

Moreover, the sensitization of a specific emulsion can be changed by varying the state in the emulsion. For instance, the sensitization can be increased by increasing the silver ion concentration or decreasing the hydrogen ion concentration or effecting them simultaneously. Thus, the sensitization can be increased by immersing a film, on which a spectral sensitized emulsion is coated, in water or an aqueous ammonia solution. A process for further sensitizing the sensitized emulsion by increasing the silver ion concentration or decreasing the hydrogen ion concentration or effecting them simultaneously, is called hyper-sensitization. An emulsion subjected to hyper-sensitization generally has low storage stability.

Sensitizing dyes for use in supersensitizing silver halide photographic emulsions must have stable photographic properties during the storage of the photographic element without causing any mutual interaction with the photographic additives other than the sensitizing dyes.

The sensitizing dyes further must not leave any residual coloring due to residual sensitizing dyes remaining in the photographic element after processing. Particularly, no residual coloring must remain after a processing for a short period of time (generally, from several seconds to several tens of seconds).

Sensitizing dyes generally leave residual coloring in other photographic layers such as a colloidal image supporting layer and/or an auxiliary layer or a support supporting the developed and fixed photographic element. Residual coloring causes difficulties particularly in the case of a photographic element for photographic printing such as a lithographic type of photographic negative which is corrected using a color mask image, i.e., which requires a pale grey. The residual coloring effect is not desirable particularly in a photographic paper. The reason is that a light white color cannot be obtained in black and white photography, and true color reproduction is impossible.

If a yellow or magenta color remains, other defects occur. That is, the residual dye is bleached by radiated ray, thereby providing an image in which a part is white and another part is colored. Thus, it is important that the photographic paper, the lithographic type of film, and other photographic elements which are produced by using a photographic emulsion sensitized with a sensitizing dye, be free of residual coloring.

Furthermore, sensitizing dyes must provide a spectrally sensitive range sufficiently safe to a safe light which is used in processing a photosensitive element. In the case of a color photosensitive member such as color positive or color paper, a safe light having a maximum transmission in the range of about 570 nm to 620 nm is used.

In the case of an X-ray photosensitive element, such as a direct X-ray element and an indirect X-ray element, a safe light using a No. 7 filter produced by Fuji Photo Film Co., is employed. The spectral transmission curve of this filter is shown in FIG. 1.

Thus, a longer wave length side of a spectral sensitizing range of the green photosensitive layer should be cut as sharply as possible so as to make the photosensitive element stable to a safe light. If not, the safe light causes fog, thereby contaminating the finished photograph.

SUMMARY OF THE INVENTION

It is an object of the present invention to provide a silver halide photographic emulsion sensitized with a combination of sensitizing dyes which provides a suppersensitization and scarcely causes any contamination of a processed photographic element.

It is another object of the present invention to provide a silver halide photographic emulsion which is sensitized with a combination of sensitizing dyes having a supersensitizing action, and in which the spectral sensitivity is not reduced during the preparation of the emulsion or the storage of the photosensitive element prior to the processing thereof even if they are present in combination with anionic compounds, particularly gelatin aggregating agents or couplers, particularly magenta couplers.

The above objects of the present invention can be attained by using the combination of dyes selected from (1) benzimidazolooxacarbocyanine dyes and (2) merocyanine dyes in a supersensitizing amount.

This invention accordingly provides a silver halide emulsion containing a supersensitizing amount of the combination of at least one dye represented by the general formula (I)

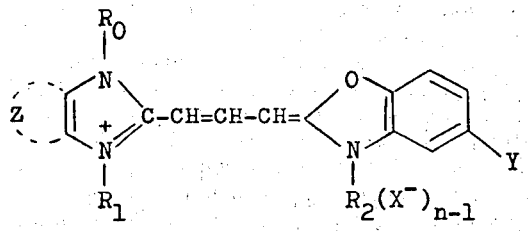

(I)

wherein Z represents the non-metal atoms necessary to form a benzene nucleus; $R_0$, $R_1$ and $R_2$ each represents aliphatic groups, with at least one of $R_1$ and $R_2$ representing an alkyl group containing a carboxy group or an alkyl group containing a sulfo group; Y represents a halogen atom; X represents an acid anion; *n* represents an integer of 1 or 2, with *n* being 1 when the dye forms an intramolecular salt; and at least one dye represented by the general formula (II)

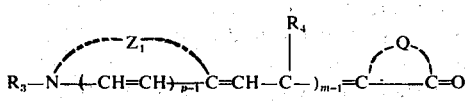

(II)

wherein $Z_1$ represents the non-metal atoms necessary to form a 5- or 6-membered heterocyclic nucleus; Q represents the atoms necessary to form a rhodanine nucleus, a 2-thio-2,4-imidazolidinedione nucleus, a 2-pyrazoline-5-one nucleus, or a 2-thio-2,4-oxazolidinedione necleus; $R_3$ represents an aliphatic group; $R_4$ represents a hydrogen atom, an alkyl group, an alkoxy group, or a mono-aryl group; *m* represents 1 or 2; and *p* represents 1 or 2.

The combination of dyes which is capable of supersensitizing according to the present invention brings about a significant advance in the photographic industry.

DETAILED DESCRIPTION OF THE INVENTION

Figure 1:
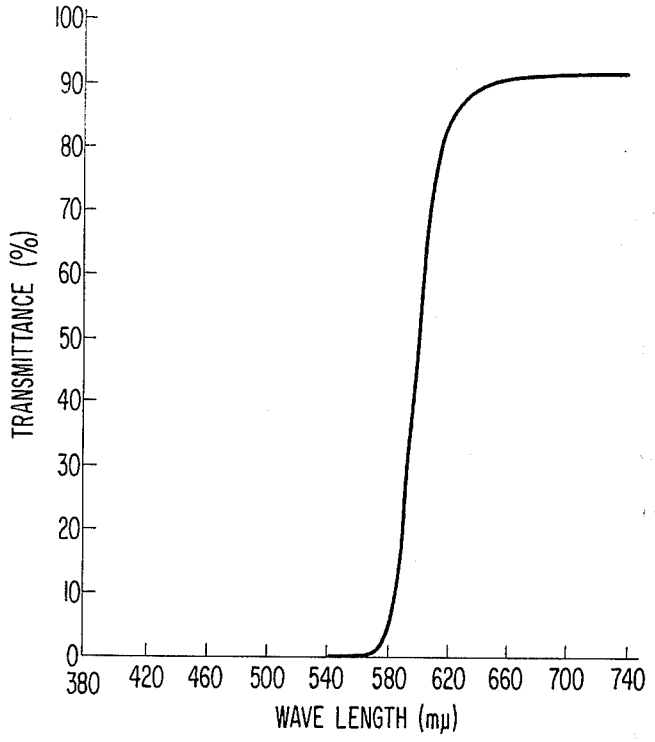
FIG. 1 shows the spectral transmittance curve of a safe light filter for obtaining a safe light which is usually used in processing an X-ray film.

The benzimidazolo oxacarbocyanine dyes which can be used in the present invention are represented by the general formula (I)

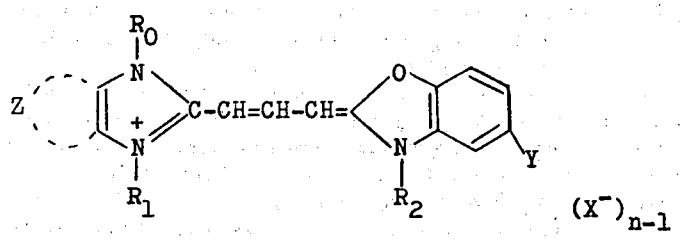

(I)

wherein Z is the non-metal atoms required for forming a benzene nucelus, which can be unsubstituted or substituted with halogen atoms such as a fluorine atom, a chlorine atom, a bromine atom, and an iodine atom; alkyl groups (e.g., having 1 to 4 carbon atoms, such as methyl, ethyl, n-propyl, trifluoromethyl, and the like); monoaryl groups (such as phenyl); and cyano groups; etc.; $R_0$, $R_1$ and $R_2$ are aliphatic groups including saturated and unsaturated aliphatic groups having, e.g., 1 to 8 carbon atoms such as unsubstituted alkyl groups (e.g., methyl, ethyl, n-propyl, and the like); substituted alkyl groups, preferably those having an alkyl moiety containing 1 to 4 carbon atoms, such as a vinylmethyl group, a hydroxyalkyl group (e.g., 2-hydroxyethyl, 4-hydroxybutyl and like), an acetoxyalkyl group (e.g., 2-acetoxy-ethyl, 3-acetoxypropyl and the like), an alkoxyalkyl group (e.g., 2-methoxyethyl, 4-methoxybutyl, and the like), a carboxy containing alkyl group (e.g., 2-carboxyethyl, 3-carboxypropyl, 2-(2-carboxyethoxy)ethyl, p-carboxybenzyl, and the like), a sulfo containing alkyl group (e.g., 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(sulfopropoxy)propyl, 2- 2-(3-sulfopropoxyethoxy ethyl, 2-hydroxy-3-(3-sulfopropoxy)propyl, p-sulfophenethyl, p-sulfobenzyl, and the like), with at least one of $R_1$ and $R_2$ being a carboxy containing alkyl group or a sulfo containing alkyl group; Y is a halogen atom such as a fluorine atom, a chlorine atom, a bromine atom, or an iodine atom; X is an acid anion which is capable of forming a salt with an ammonium cation of a basic cyanine nucleus, including a mineral acid anion and an organic acid anion, such as chloride, bromide, iodide, thiocyanate, sulfate, perchlorate, p-toluenesulfonate, methylsulfurate; and *n* is 1 or 2, with *n* being 1 when the dye forms an intramolecular salt.

The merocyanine dyes which can be advantageously used in the present invention are represented by the general formula (II)

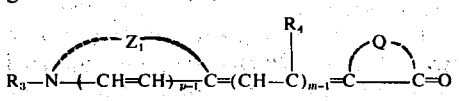

(II)

wherein $Z_1$ is the non-metal atoms required for forming a 5-or 6-membered heterocyclic nucleus. The heterocyclic nuclei formed by $Z_1$ can be substituted with alkyl groups containing 1 to 4 carbon atoms (e.g., methyl, ethyl, propyl, etc.), monoaryl groups (e.g., such as phenyl, tolyl, etc.), halogen atoms (e.g., such as chlorine, bromine, and fluroine), alkoxy groups containing 1 to 4 carbon atoms (e.g., methoxy, ethoxy, etc.) carboxy groups, monoaralkyl groups, trifluoromethyl groups, hydroxy groups, alkoxycarbonyl groups having an alkyl moiety containing 1 to 4 carbons (e.g., methoxycarbonyl, ethoxycarbonyl, etc.), cyano groups, and the like, or these substituents may condense with a saturated hydrocarbon forming a 6 membered ring.

Examples of heterocyclic nuclei for $Z_1$ are thiazole nuclei such as thiazole, 4-methylthiazole, 4-phenylthiazole, 4,5-dimethylthiazole, 4,5-diphenylthiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, 5-phenylbenzothiazole, naphtho[2,1-d]thiazole, naphtho[1,2-d]-thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxy[2,3-d]thiazole, and the like; thiazoline nuclei such as thiazoline, 4-methylthiazoline, and the like; oxazole nuclei such as oxazole, 4-methyloxazoie, 4-ethyloxazole, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole, and the like; selenazole nuclei such as 4-methylselenazole, 4-phenylselenazole, benzoselenazole, 5-chlorobenzoselenazole, 5-methoxybenzoselenazole, 5-methylbenzoselenazole, 5-hydroxybenzoselenazole, 5-hydroxybenzoselenazole, naphtho[2,1-d]selenazole, naphtho[1,2-d]selenazole, and the like; 3,3-dialkylindolenine nuclei such as 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, and the like; imidazole nuclei such as 1-methylimidazole, 1-ethylimidazole, 1-methyl-4-phenylimidazole, 1-ethyl-4-phenylimidazole, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-alkyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-ethylnaphtho[1,2-d]imidazole, 1-allyl-5,6-dichlorobenzimidazole, 1-allyl-5-chlorobenzimidazole, 1-phenylimidazole, 1-phenylimidazole, 1-phenylimidazole, 1-phenyl-5-chlorobenzimidazole, 1-phenyl-5,6-dichlorobenzimidazole, 1-phenyl-5-methoxybenzimidazole, 1-phenyl-5-cyanobenzimidazole, 1-phenylnaphtho[1,2-d]imidazole, and the like; tetrazole nuclei such as 1,3-dimethyltetrazole, 1-methyl-3-ethyltetrazole, and the like; pyridine nuclei such as pyridine, 5-methyl-2-pyridine, 3-methyl-4-pyridine, and the like; etc.; Q is the atoms required to form: rhodanine nuclei such as 3-ethylrhodanine, 3-allylrhodanine, 3-carboxymethylrhodanine, 3-(2-carboxyethyl)rhodanine, 3-(4-carboxybutyl)rhodanine, 3-(2-sulfoethyl)rhodanine, 3-(2-sulfoethyl)rhodanine, 3-(3-sulfopropyl)rhodanine, 3-(4-sulfobutyl)-rhodanine, 3-phenylrhodanine, 3-benzylrhodanine, 3-cyclohexylrhodanine, 3-(p-chlorophenyl)rhodanine, and the like; 2-thio-2,4-imidazolidinedione nuclei such as 2-thio-2,4-imidazolidinedione, 3-ethyl-2-thio-imidazolidinedione, 3-(4-sulfobutyl)-2-thio-2,4-imidazolidinedione, 3-(2-carboxyethyl)-2-thio-2,4-imidazolidinedione, 3-phenyl-2-thio-2,4-imidazolidinedione, 3-α-naphthyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-α-naphthyl-2-thio-2,4-imidazolidinedione, 1,3-diphenyl-2-thio-2,4-imidazolidinedione, 1-(2-carboxyethyl)-3 -phenyl-2-thio-2,4-imidazolidinedione, 1-phenyl-3-ethyl-2-thio-2,4-imidazolidinedione, 1-(2-hydroxy)-3-phenyl-2-thio-2,4-imidazolidinedione, 1-(3-hydroxypropyl)-3-phenyl-2-thio-2,4-imidazolidinedione, 1-(2-carboxyethyl)-3-(p-chlorophenyl)-2-thio-2,4-imidazolidinedione, 1-ethyl-3-n-butyl-2-thio-2,4-imidazolidinedione, and the like; 2-pyrazoline-5-one nuclei such as 3-methyl-1-phenyl-2-pyrazoline-5-one, 1-phenyl-2-pyrazoline-5-one, 1-(2-benzthiazolyl)-3-methyl-2-pyrazoline-5-one, 1,3-diphenyl-2-pyrazoline-5-one, 3-methyl-1-p-sulfophenyl-2-pyrazoline-5-one, and the like; or 2-thio-2,4-oxazolidinedione nuclei such as 3-ethyl-2-thio-2,4-oxazolidinedione, 3-(2-sulfoethyl)-2-thio-2,4-oxazolidinedione, 3-(4-sulfobutyl)-2-thio-2,4-oxazolinedione, 3-(3-carboxypropyl)-2-thio-2,4-oxazolidinedione, 3-(2-hydroxyethyl)-2-thio-2,4-oxazolidinedione, 3-carboxymethyl-2-thio-2,4-oxazolidinedione, 3-phenyl-2-thio-2,4-oxazolidinedione, 3-hexyl-2-thio-2,4-oxazolidinedione, and the like; $R_3$ is an aliphatic group set forth for $R_0$, $R_1$ and $R_2$; $R_4$ is a hydrogen atom; and alkyl group, preferably containing 1 to 4 carbon atoms such as methyl, ethyl, and the like; an alkoxy group, preferably containing 1 to 4 carbon atoms such as methoxy, ethoxy, and the like; or a monoaryl group such as phenyl; $m$ is 1 or 2; and $p$ is 1 or 2.

A feature of the present invention resides in the discovery that a supersensitizing effect can be obtained by using an effective amount of the combination of the benzimidazolo oxacarbocyanine dye represented by the general formula (I) and the merocyanine dye represented by the general formula (II). No combination of sensitizing dyes which exhibits supersensitizaton could be expected from the chemical structures thereof. A slight difference in the chemical structure influences significantly the supersensitivity.

For instance, it is difficult to expect supersensitization from a combination of dyes even though the combination will broaden the spectral sensitizing range.

In this invention it has been found that a benzimidazolo oxacarbocyanine dye comprising a benzoxazole nucleus having a "methoxy substituent" at the 5-position thereof, when used alone, does not exhibit any supersensitizing action, but that a benzimidazolo oxacarbocyanine dye comprising a benzoxazole nucleus having a "halogen atom" at the 5-position thereof, when used in combination with the merocyanine dye, exhibits unexpectedly a supersensitizing action.

In the present invention, the concentration and ratio of sensitizing dyes are important.

A preferred amount of each of sensitizing dyes used in the present invention ranges from about $2.0 \times 10^{-6}$ to about $1.0 \times 10^{-3}$ mole per gram mole of the silver halide.

A preferred molar ratio of the dye represented by the general formula (I) to the dye represented by the general formula (II) ranges from about 2:1 to 20:1, with a ratio of about 3:1 to 16:1 being most preferred.

When Dye A (200 mg/mole Ag) or Dye F (100 mg/mole Ag) is used alone, the minus blue speed is 100 or 67, respectively, whereas when the Dye A (200 mg/mole Ag) and the Dye F (100 mg/mole Ag) are used simultaneously, the minus blue speed is 115. With a great deal of dyes as well as the Dyes A and F, the sensitivity to the extent as described above can be generally obtained at lower concentration than those when they are used alone. This fact is derived experimentally and is well known to one skilled in the art.

Dye A: Anhydro-1'-allyl-5'-chloro-ethyl-5-methoxy-3'-(3-sulfopropyl)-benzoimidazolooxacarbocyanine hydroxide Dye F: 3-Ethyl-5-[(3-ethyl-2-benzoxazolinilydene)-1-methylethylidene]rhodanine Another feature of the present invention is that the formation of residual coloring due to the sensitizing dye remaining in the processed photographic element is minimized with the combination of the dyes of the present invention. With a benzimidazolo oxacarbocyanine dye comprising a 5-position halogen substituted benzoxazole nucleus represented by the general formula (I), the formation of the residual coloring is slight as compared with a dye comprising a 5-position methoxy substituted benzoxazole nucleus. Particularly, where a dye comprising a 5-position fluorine or chlorine substituted benzoxazole nucleus is used, the residual coloring is substantially non-existent.

Another feature of the present invention is that the combination of the dyes of the present invention provides a high spectral sensitivity even though the combination of dyes is used in combination with anionic compounds such as a dye for preventing irradiation containing a sulfo group in the chemical structure thereof, and a gelatin aggregating agent containing a sulfo group, and/or an internal coupler for a color photosensitive member, which are considered to inhibit spectral sensitization. It might be presumed that when a dye in which the nitrogen atom of a heterocyclic ring is substituted with an alkyl group containing a sulfo group or carboxyl group is used along with a coupler, a high spectral sensitivity generally is obtained. However, it has been confirmed that the dyes of the general formula (I) or the general formula (II), when used alone in combination with a color coupler provide substantially no spectral sensitization. Thus, it is surprising that the combination of the dyes represented by the general formula (I) and the dyes represented by the general formula (II) provides a high spectral sensitivity in the presence of a coupler.

Another feature of the present invention is that the combination of the present invention provides a spectral sensitivity distribution sufficiently stable to a safe light which is used for a color positive film or color paper, or which is provided with a No. 7 Filter produced by the Fuji Photo Film Co., Ltd. and used for an X-ray photosensitive element. A benzimidazolo oxacarboxyanine dye comprising a 5-position halogen atom substituted benzoxazole nucleus provides a maximum sensitization at a shorter wave length as compared with a benzimidazolo oxacarbocyanine dye comprising a 5-position methoxy substituted benzoxazole nucleus and thus it is stable to the above safe light.

The following are typical examples of the benzimidazolo oxacarbocyanine dyes represented by the general formula (I) which can be used in the invention although the present invention is not to be construed as being limited thereto.

I - 1

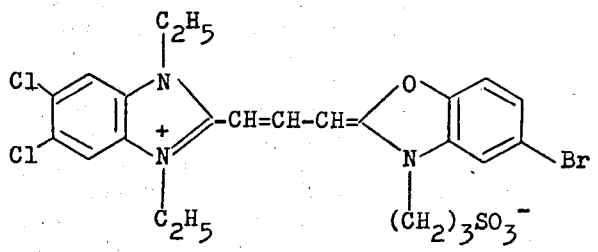

I - 2

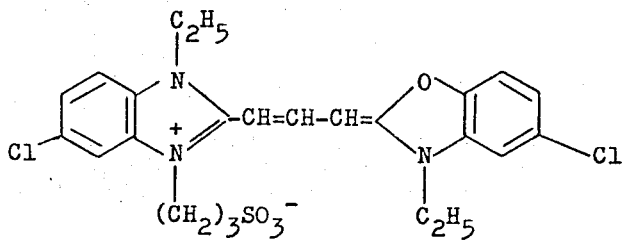

I - 3
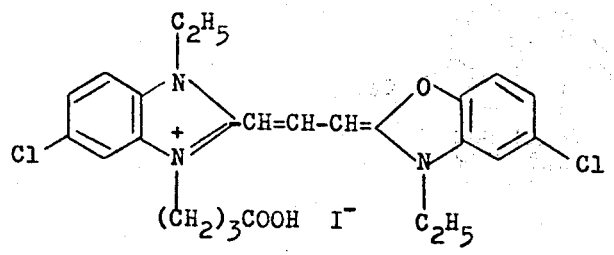
I - 4
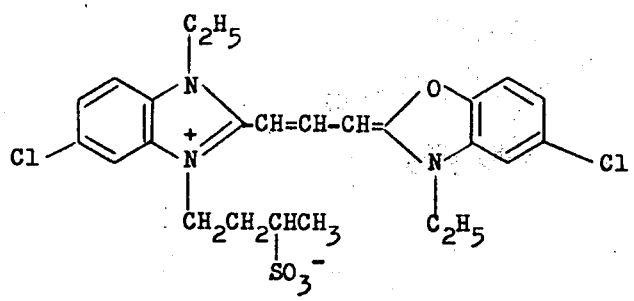
I - 5
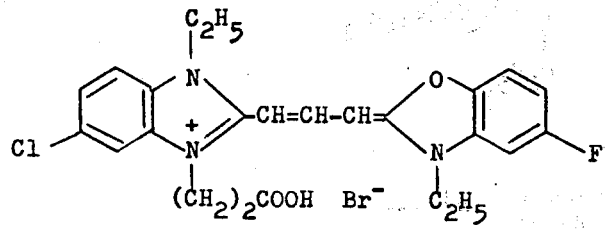
I - 6
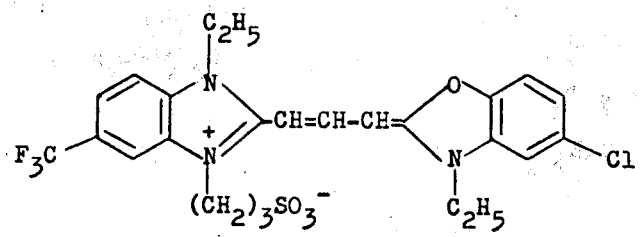
I - 7
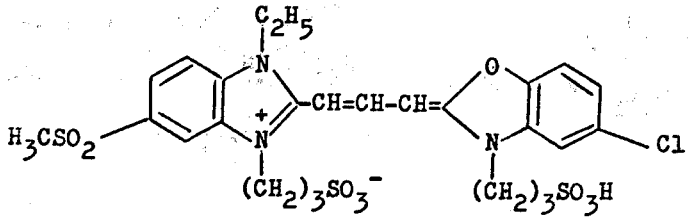

I - 8
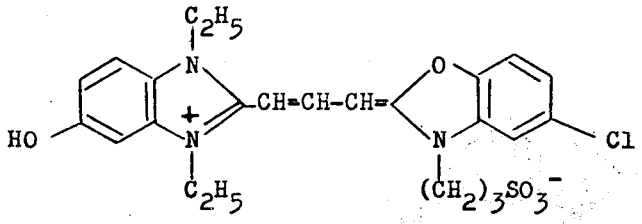
I - 9
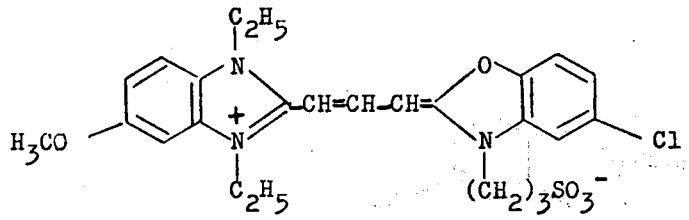
I - 10
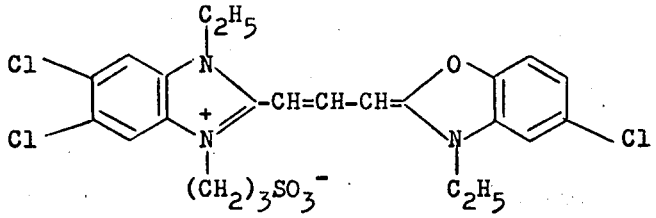
The following are typical examples of merocyanine dyes represented by the general formula (II) which can be used in the invention although the present invention is not to be construed as being limited thereto.
II - 1
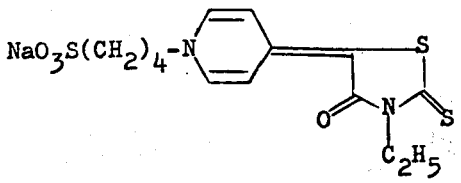
II - 2
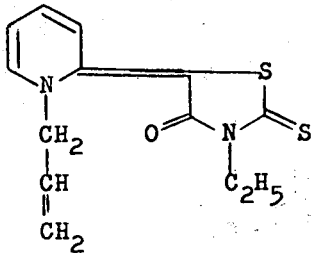
II - 3
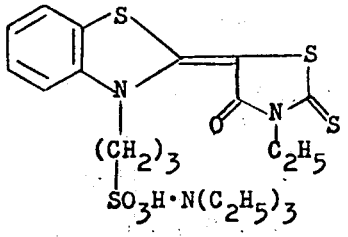
II - 4
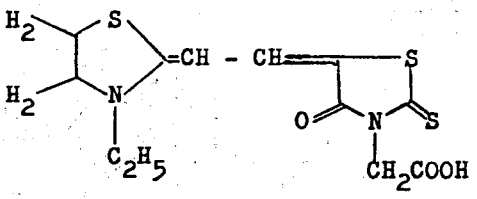

II - 5
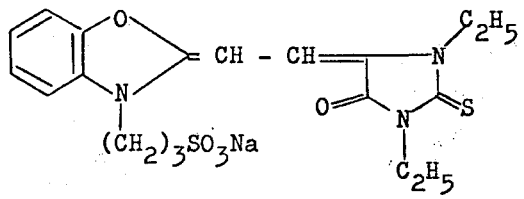
II - 6
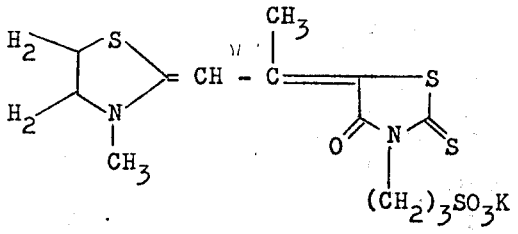
II - 7
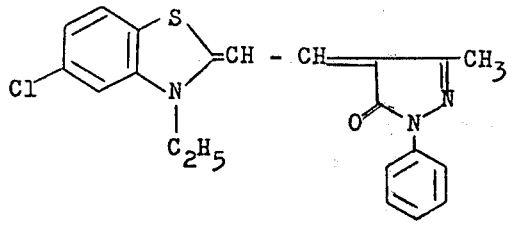
II - 8
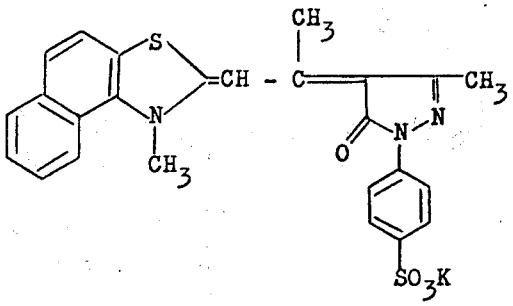
II - 9
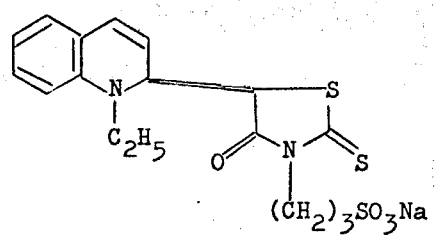

II - 10
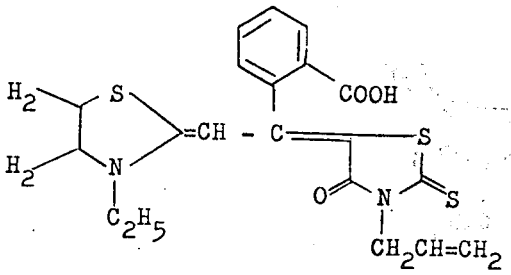
II - 11
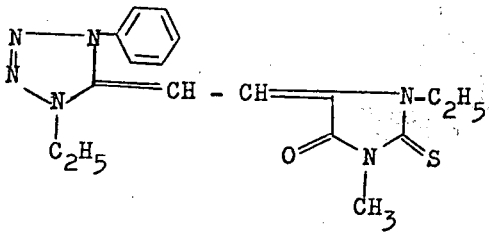
II - 12
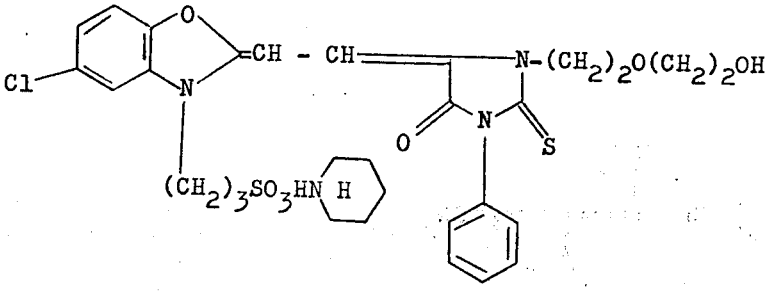
II - 13
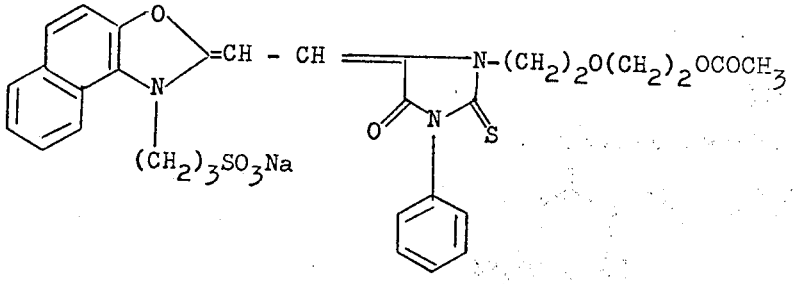

II - 14

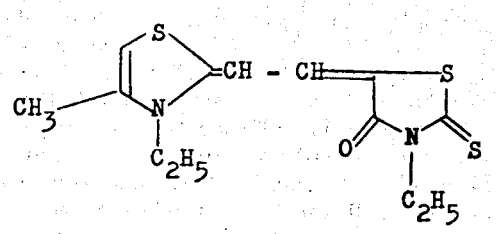

II - 15

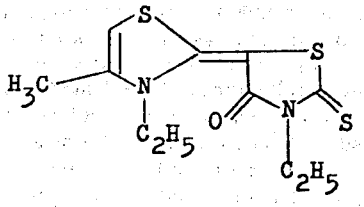

II - 16

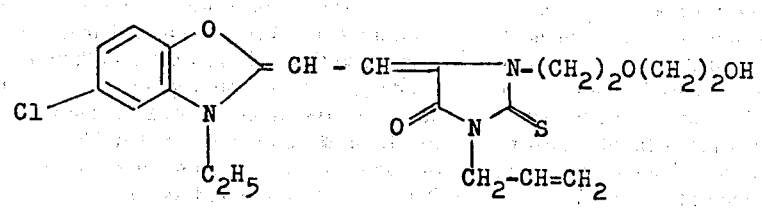

The dyes represented by the general formula (I) are described in Japanese Patent Publication No. 14030/1969 and so on, and thus one skilled in the art can synthesize these dyes by referring to this patent publication. Those dyes which are not described in the specification can be prepared in a similar manner.

The dyes represented by the general formula (II) are described in U.S. Pat. Nos. 2,493,748, 2,519,001, 2,652,330 and 3,288,610; German Patent No. 1,177,481; and so on. Thus, one skilled in the art can easily prepare them referring to the above mentioned patents as well as to F.M. Hamer, *The Cyanine Dyes and Related Compounds*, page 511, Interscience Publishers, New York (1964). Those dyes which are not described in these references can be also easily prepared in a similar manner.

The most suitable concentration of the dye can be determined in the manner known to one skilled in the art, wherein an emulsion is divided into several portions, to each of which dyes in different concentrations are added and their sensitivity is measured.

The addition of the sensitizing dyes of the emulsion can be carried out by the methods well known in the art.

These sensitizing dyes can be directly dipersed in the emulsion or can be first dissolved in water-miscible solvents such as pyridine, methyl alcohol, ethyl alcohol, methyl cellosolve, acetone and the like and mixtures thereof, or diluted with water, or dissolved in water, and then added to the emulsion in the form of a solution. Supersonic vibration can be applied to the solution. Moreover, the techniques as described in Japanese Patent Publication Nos. 8231/1970, 23389/1969, 27555/1969, and 22948/1969; German Patent Laid-open No. 1,947,935; U.S. Pat. Nos. 3,485,634, 3,342,605, and 2,912,343; etc.; can be used.

These sensitizing dyes can be dissolved in different solvents and added to the emulsion separately or they can be dissolved in the same or different solvents and mixed prior to the addition thereof to the silver halide emulsion. It is necessary to uniformly disperse the sensitizing dyes in the emulsion before the emulsion is coated on an appropriate support such as a glass, cellulose derivative films, polyvinyl resin films, e.g., polystyrene film. polyvinyl chloride, and the like, polyester films, a synthetic paper, a baryta paper, and a polyolefin coated photographic paper, etc. A suitable coating amount of silver ranges from about 0.001 mol to 0.1 mol per $m^2$ of the support. The addition of the sensitizing dyes to the emulsion can be carried out at any stage during the preparation of the emulsion and conveniently carried out after the second ripening is completed.

Suitable silver halides which can be used in the present invention include silver chloride, silver bromide, silver iodide, silver chlorobromide, silver iodobromide, and silver iodochlorobromide, etc.

The emulsion can be in the form of coarse particles or fine particles or a mixture thereof. These silver halide particles can be formed using known methods such as a single jet method, a double jet method and a control double jet method.

Moreover, the crystal structure of the silver halide particle can be uniform throughout, can be in a layer structure comprising a core and a shell, or can be in the so-called converted type as described in British Patent No. 635,841 and U.S. Pat. No. 3,622,318. The type in which a latent image is formed mainly on the surface of the particle or the internal latent image type in which a latent image is formed in the inner portion of the particle, can be employed.

These photographic emulsions are described in Mees, *The Theory of the Photographic Process* published by Macmillan and Grafikides, *Photographic Chemistry* published by Fountain Press, etc. and can be prepared using various methods such as the ammonia process, neutral process, acidic process, and the like which are well known to one skilled in the art.

These silver halide particles when formed are washed to remove the by-produced water-soluble salts. e.g. potassium nitrate where silver bromide is produced from silver nitrate and potassium bromide, and heat-treated in the presence of a chemical sensitizing agent, whereby the sensitivity can be increased without more coarse-graining the particles. In some cases, the silver halide particles are used as they are without removing the by-produced water-soluble salts. Such methods are described in the above mentioned literature.

The average diameter of the silver halide particle as used in the present invention as measured, for example, by the projected area method and number average method is not particularly limited, but preferably ranges from about 0.04 $\mu$ to about 2 $\mu$.

To the silver halide photgraphic emulsion, various sensitizing methods such as the conventionally used chemical sensitizing methods, e.g. gold sensitization as described in U.S. Pat. Nos. 2,540,085, 2,597,876, 2,597,915, and 2,399,083, etc.; VIII group metal ion sensitization; sulfur sensitization as described in U.S. Pat. Nos. 1,574,944, 2,278,947, 2,440,206, 2,410,689, 3,189,458 and 3,415,649, etc.; reduction sensitization as described in U.S. Pat. Nos. 2,518,698, 2,419,974, and 2,983,361, etc.; and combinations thereof, can be applied.

Representative examples of chemical sensitizing agents include sulfur sensitizing agents such as allyl thiocarbamide, thiourea, sodium thiosulfate, cystine, and the like; noble metal sensitizing agents such as potassium chloroaurate, aurous thiosulate, potassium chloropalladate and the like; reducing sensitizing agents such as stannous chloride, phenylhydrazine, reductone, and the like; etc.

Sensitizing agents such as polyoxyethylenes derivatives as described in British Patent No. 981,470, Japanese Patent Publication No. 6475/1956, and U.S. Pat. No. 2,716,062, etc., polyoxypropylene derivatives, quaternary ammonium group containing derivatives, etc. can be included.

The silver halide emulsion can contain appropriate antifoggants and stabilizers. The thiazolium salts as described in U.S. Pat. Nos. 2,131,038 and 2,694,716; azaindenes as described in U.S. Pat. Nos. 2,886,437 and 2,444,605; urazoles as described in U.S. Pat. No. 3,287,135 and so on; sulfocatechols as described in U.S. Pat. No. 3,236,652 and so on; sulfocatechols as described in U.S. Pat. No. 3,236,652 and so on; oximes as described in British Pat. No. 623,448 and so on; mercaptotetrazoles as described in U.S. Pat. Nos. 2,403,927, 3,266,897, 3,397,987 and so on; nitrons; nitroindazoles; polyvalent metal salts as described in U.S. Pat. No. 2,839,405 and so on; thiuronium salts as described in U.S. Pat. No. 3,220,839; salts of noble metals, e.g. palladium, platinum, gold, etc. as described in U.S. Pat. Nos. 2,566,263, 2,597,915, and so on, can be used.

Moreover, the silver halide emulsion can contain main developing agents such as hydroquinones, catechols, acylphenols, 3-pyrazolidones, ascorbic acid and derivatives thereof, reductones, phenylenediamines, etc. and mixtures thereof. The main developing agent is included in the silver halide emulsion and/or another appropriate layer of the photographic element. The main developing agent is dissolved in an appropriate solvent and added in the form of the dispersion as described in U.S. Pat. No. 2,592,368 and French Pat. No. 1,505,778.

The silver halide as used in the present invention can be dispersed in colloids which can be hardened with various organic or inorganic hardening agents such as formaldehye, chrome alum, 1-hydroxy-3,5-dichlorotriazine sodium salt, glyoxal, and dichloroacrolein, etc.

The silver halide photographic emulsion can contain auxiliary coating agents such as saponin, alkylaryl sulfonates as described in U.S. Pat. No. 2,600,831, and so on, and amphoteric compounds as described in U.S. Pat. No. 3,133,816 and so on.

The silver halide photographic emulsion as used in the present invention can control antistatic agents, plasticizers, fluorescent brightening agents, development accelerators, anti aerial-fog agents, and color controlling agents, etc.

Color couplers can be present depending on the end use purpose and are described in U.S. Pat. Nos. 3,311,476, 3,006,759, 3,277,155, 3,214,437, 3,253,924, 2,600,788, 2,801,171, 3,252,924, 2,698,794 and 2,474,293, and British Patent No. 1,140,898, etc.

As the dye for preventing irradiation, those dyes as described in Japanese Patent Publication Nos. 20389/1966, 3504/1968 and 13168/1968; U.S. Pat. Nos. 2,697,037, 3,423,207 and 2,865,752; British Patent Nos. 1,030,392 and 1,100,546, etc., can be used.

In the present invention, the gelatin silver halide emulsion is generally used and in place of the gelatin, albumin, agar agar, gum arabic, alginic acid, etc. or hydrophilic resins such as polyvinyl pyrrolidone, or cellulose derivatives, which do not adversely affect the photosensitive silver halide, can be used.

To the combination of the dyes of the present invention, other sensitizing agents can be added. The combination of the dyes of the general formula (I), the dyes of the general formula (II) and a methine dye such as a carbocyanine dye providing supersensitization can be advantageously used.

As red-sensitive sensitizing dyes which can be used in combination with the combination of the dyes of the present invention, a thia- or selena-carbocyanine which has at least one sulfoalkyl group as the N-substituent of the basic heterocyclic ring of the cyanine, can be used.
Representative examples of the red-sensitive dyes are as follows.
(A)
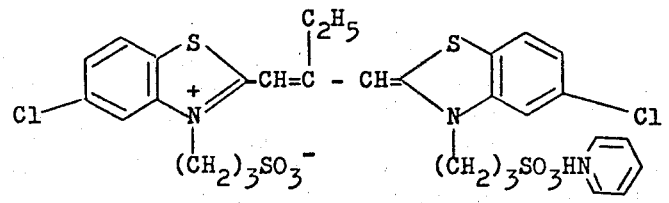
(B)
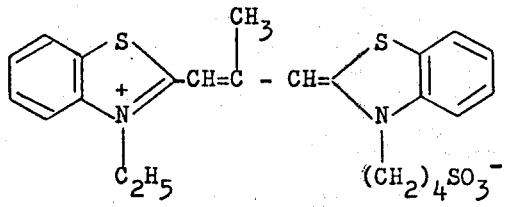
(C)
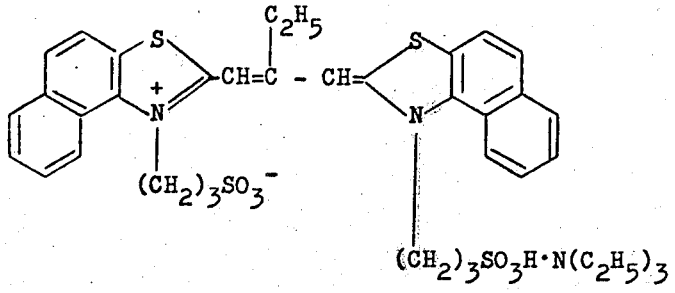
(D)
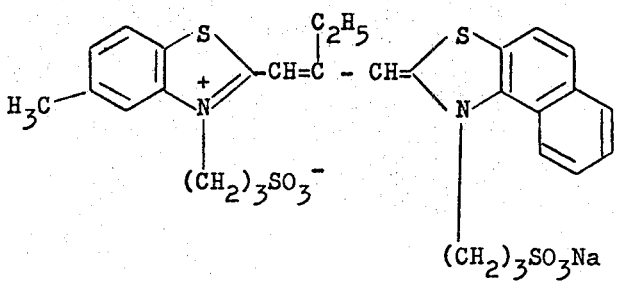

(E)

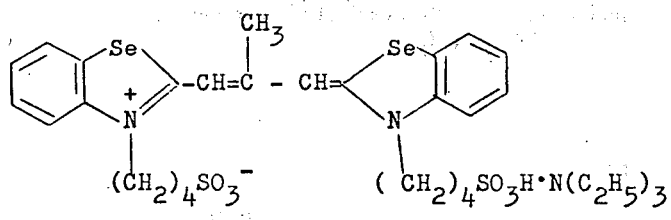

The combination of the dyes of the present invention can be used in the sensitization of various silver halide emulsions for black and white or color photographic materials, such as an emulsion for color positive materials, an emulsion for color papers, an emulsion for color negative materials, an emulsion for color reversal materials, which can contain a coupler, an emulsion for photographic photosensitive materials for printing, an emulsion for use in photosensitive materials for recording the display of a cathode ray tube, an emulsion for use in photosensitive materials for radiography with the use of a fluorescent screen, an emulsion for use in the diffusion transfer process as described in, for example, U.S. Pat. No. 2,716,059, an emulsion for use in the silver salt diffusion transfer process as described in, for example, U.S. Pat. Nos. 2,352,014, 2,543,181, 3,020,155, and 2,861,885, an emulsion for use in the color diffusion transfer process as described in, for example, U.S. Pat. Nos. 3,087,817, 3,185,567, 2,983,606, 3,253,915, 3,227,550, 3,227,551, 3,227,552, 3,415,644, 3,415,645, and 3,415,646, an emulsion for use in the dye transfer process as described, for example, U.S. Pat. No. 2,882,156, an emulsion for use in silver dye bleaching process as described in, for example, Friedman *History of Color Photography* American Photographic Publishers Co. (1944), particularly Chapter 24 and *British Journal of Photography* Vol. 111, pages 308–309 (April 7, 1964), an emulsion for use in a material for recording print out images as described in, for example, U.S. Pat. No. 2,369,449 and Belgian Patent No. 704,255, an emulsion for use in a photosensitive material for recording direct print images as described in, for example, U.S. Pat. Nos. 3,033,682, and 3,287,137, an emulsion for use in a photosensitive material for thermal development as described in, for example, U.S. Pat. Nos. 3,152,904, 3,312,550, and 3,148,121, and British Pat. No. 1,110,046, and an emulsion for use in a photosensitive material for physical development as described in, for example, British Patent Nos. 920,277 and 1,131,238, etc.

The following Examples are given to illustrate embodiments of the present invention. These examples are illustrative, and the present invention is not to be considered as being limited thereto. Unless otherwise indicated, all parts, percents ratios and the like are by weight.

EXAMPLE 1

Sensitizing Dyes 1-2 and II-5 were added, alone or in combination with each other, to a silver iodide bromide emulsion (AgI:AgBr=7 mol%:93 mol%; gelatin(g)/Ag-$NO_3$(g)=1.3; 0.53 mol silver salt/Kg emulsion) to thereby produce silver halide photographic emulsions. The average grain size of the silver halide was 0.7 microns. These emulsions were coated on a cellulose triacetate film base and dried.

The thus obtained photosensitive elements were subjected to a wedge exposure through a Wratten Filter No. 16 (a yellow filter for the measurement of minus blue speed) under 64 lux of day light color (which is equivalent to a color temperature of 5400°K) for 1/50 of a second and developed with a developing liquid comprising the following ingredients at 20°C for 6 minutes, which was further stopped, fixed, washed, and dried.

The minus blue speed and fog of these elements were measured with a p-type densitometer produced by Fuji Photo Film Co., Ltd. The optical density of the base point at which the sensitivity was determined was 0.20 above fog. The results obtained are shown in Table 1 as relative values.

| Developing Liquid Composition | |
|---|---|
| Metol | 2 g |
| Sodium Sulfite (anhydrous) | 40 g |
| Hydroquinone | 4 g |
| Sodium Carbonate (monohydrate) | 28 g |
| Potasium Bromide | 1 g |
| Water to make | 1 liter |

Table 1

| Run No. | Sensitizing Dye and Amount Thereof | | Relative Minus Blue Speed | Fog | Residual** Coloring |
|---|---|---|---|---|---|
| | | ($10^{-5}$mol/Ag mol) | | | |
| 1 | I-2 | (7) | 122 | 0.08 | None |
| 2 | " | (14) | 157 | 0.08 | " |
| 3 | " | (28) | 210 | 0.08 | " |
| 4 | " | (56) | 174 | 0.08 | " |
| 5 | I-A* | (7) | 139 | 0.08 | " |
| 6 | " | (14) | 186 | 0.08 | " |
| 7 | " | (28) | 229 | 0.08 | very slight |
| 8 | " | (56) | 220 | 0.08 | slight |
| 9 | II-5 | (1.7) | 79.5 | 0.06 | None |
| 10 | " | (3.5) | 100 (base point) | 0.06 | " |
| 11 | " | (7) | 124 | 0.06 | " |
| 12 | " | (14) | 145 | 0.07 | " |

Table 1-continued

| Run No. | Sensitizing Dye and Amount Thereof | | | | Relative Minus Blue Speed | Fog | Residual** Coloring |
|---|---|---|---|---|---|---|---|
| 13 | " | (21) | | | 141 | 0.07 | " |
| 14 | I-2 | (7) | II-5 | (7) | 152 | 0.08 | " |
| 15 | " | (14) | " | (35) | 240 | 0.08 | " |
| 16 | " | (28) | " | (1.7) | 235 | 0.08 | " |
| 17 | I-A | (7) | II-5 | (7) | 145 | 0.08 | " |
| 18 | " | (14) | " | (35) | 171 | 0.08 | " |
| 19 | " | (28) | " | (1.7) | 206 | 0.08 | very slight |
| 20 | " | (56) | " | (1.7) | 195 | 0.08 | slight |
| 21 | II-7 | (1.7) | | | 95 | 0.09 | None |
| 22 | " | (35) | | | 97 | 0.09 | " |
| 23 | " | (7) | | | 91 | 0.10 | " |
| 24 | " | (14) | | | 71 | 0.12 | " |
| 25 | I-2 | (7) | II-7 | (7) | 150 | 0.08 | " |
| 26 | " | (14) | " | (35) | 204 | 0.09 | " |
| 27 | " | (28) | " | (1.7) | 200 | 0.09 | " |
| 28 | I-A | (7) | II-7 | (7) | 145 | 0.10 | " |
| 29 | " | (14) | " | (35) | 186 | 0.09 | " |
| 30 | " | (28) | " | (1.7) | 178 | 0.09 | very slight |

*Comparative Dye I-A

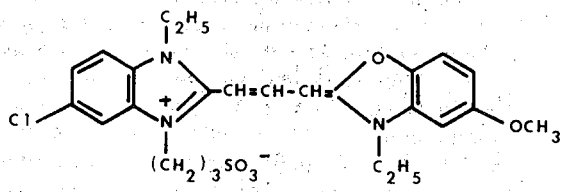

**slight>very slight>none

It can be seen from the results in Table 1 that the sensitivity as obtained with the combination of Comparative Dye I-A (7) and Dye II-5 (7) is higher than those obtained using the dyes alone, but lower than those obtained usng Comparative Dye I-A (14) and Dye I-A (28), alone. The case is the same with the combination of Dye I-2 (7) and Dye II-5 (7).

The sensitivity using the combination of Dye I-(14) and Dye II-5(3.5) is higher than those using the dyes alone and higher than that using Comparative Dye I-A alone. However, the sensitivity using the combination of Comparative Dye I-A (14) and Dye II-5 (3.5) is lower tha those using Comparative Dye I-A (14) or (28).

Figure 2:
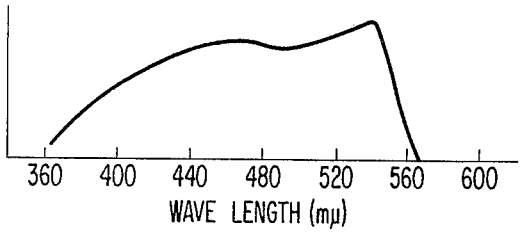
FIG. 2 shows a spectrogram of Run No. 15 in Example 1.
Figure 3:
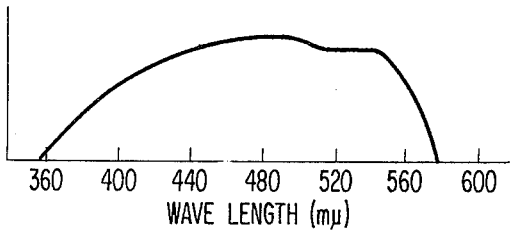
FIG. 3 shows a spectrogram of Run No. 18 in Example 1.

Spectrograms of Run Nos. 15 and 18 are shown in FIGS. 2 and 3, respectively.

Likewise, the sensitivity using the combination of Comparative Dye I-A (7) and Dye II-7 (7) is higher than those obtained using the dyes alone, but lower than those obtained using Comparative Dye I-A (14) or (28). The same is the case with the combination of Dye I-2 (7) and Dye II-7 (7). However, the sensitivity obtained using the combination of Dye I-2 (14) and Dye II-8 (3.5) is higher than those as obtained using the dyes alone. The sensitivity, however, as obtained using the combination of Comparative Dye I-A (28) and Dye II-7 (1.7) is lower than those as obtained using Comparative Dye I-A (28).

EXAMPLE 2

Sensitizing dyes as indicated in Table 2 were added, alone or in combination with each other, to a silver chloroiodobromide emulsion (AgI 0.25 mol%, AgBr 16.5 mol%; gelatin (g)/$AgNO_3$(g)=0.35; 1.18 mol silver salt/Kg emulsion; average grain size of silver halide: 0.4 microns) to thereby prepare silver halide emulsions. These emulsions were coated on cellulose triacetate bases and dried.

The thus obtained photosensitive elements were subjected to a wedge exposure under 256 lux using a day light color (which is equivalent to a color temperature a 5400°K) through a yellow filter SC-50 produced by the Fuji Photo Film Co., Ltd. for 1/20th of a second and developed with the same developer as used in Example 1 at 20°C. for 6 minutes, which was stopped, fixed, washed, and dried.

The minus blue speed and fog were measured using a P-type densitometer produced by Fuji Photo Film Co., Ltd. The optical density of the base point was 0.20 above fog. The results obtained are shown in Table 2 as relative values.

Table 2

| Sensitizing Dye and Amount Thereof | | | | Relative Minus Blue Speed | | Fog |
|---|---|---|---|---|---|---|
| | ($10^{-5}$)mol/Ag mol) | | | | | |
| I-4 | (28) | | | 73.5 | | 0.10 |
| " | (56) | | | 100 | (base point) | |
| " | (84) | | | 85.5 | | 0.10 |
| | | II-6 | (28) | 76.5 | | 0.10 |
| | | " | (56) | 100 | | 0.10 |
| | | " | (84) | 89.5 | | 0.11 |
| I-14 | (56) | II-6 | (14) | 114 | | 0.10 |
| " | (56) | " | (7) | 120 | | 0.10 |
| | | II-9 | (14) | 34.8 | | 0.12 |
| | | " | (28) | 48.5 | | 0.12 |
| | | " | (56) | 44.8 | | 0.12 |
| I-14 | (56) | II-8 | (14) | 126 | | 0.12 |
| " | (56) | " | (7) | 123 | | 0.10 |
| I-10 | (28) | | | 77 | | 0.10 |
| " | (56) | | | 100 | | 0.10 |
| " | (84) | | | 96 | | 0.10 |
| | | II-4 | (14) | 96 | | 0.10 |
| | | " | (28) | 96 | | 0.10 |
| | | " | (56) | 85.5 | | 0.11 |
| I-10 | (56) | II-4 | (14) | 134 | | 0.11 |
| " | (56) | " | (7) | 122 | | 0.10 |

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing in a supersensitizing amount a combination of dyes which provides minus blue supersensitivity which consists essentially of at least one sensitizing dye represented by the general formula (I)

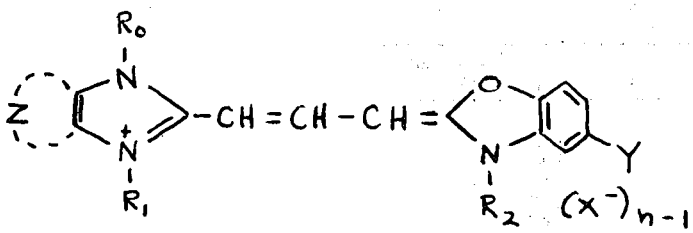

wherein Z represents the non-metal atoms necessary to form a benzene nucleus; $R_0$, $R_1$, and $R_2$ each represents an aliphatic group, with at least one of $R_1$ and $R_2$ representing an alkyl group containing a carboxy group or an alkyl group containing a sulfo group; Y represents a halogen atom; X represents an acid anion; *n* represents an integer of 1 or 2 with *n* being 1 when the dye forms an intramolecular salt; and at least one sensitizing dye represented by the general formula (II)

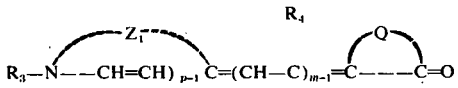

wherein $Z_1$ represents the non-metal atoms necessary to form a 5- or 6-membered heterocyclic nucleus; Q represents the atoms necessary to form a rhodanine nucleus, a 2-thio-2,4-imidazolidine-dione nucleus, a 2-pyrazoline-5-one nucleus, or a 2-thio-2,4-oxazolidinedione nucleus; $R_3$ represents an aliphatic group; $R_4$ represents a hydrogen atom, an alkyl group, an alkoxy group, or a mono-aryl group; *m* represents 1 or 2; and *p* represents 1 or 2.

2. The silver halide photographic emulsion according to claim 1, wherein the molar ratio of the dye represented by the general formula (I) to the dye represented by the general formula (II) ranges from about 3:1 to about 16.1.

3. The silver halide photographic emulsion according to claim 1, wherein the heterocyclic ring formed by Q in the general formula (II) is a 2-thio-2,4-imidazolidinedione nucleus.

4. The silver halide photographic emulsion according to claim 1, wherein the heterocyclic ring formed by Q in the general formula (II) is a rhodanine nucleus.

5. The silver halide photographic emulsion according to claim 1, wherein Y in the general formula (I) is a chlorine atom.

6. A silver halide photographic emulsion containing in a supersensitizing amount the combination of anhydro-1-ethyl-3-γ-sulfopropyl-3′-ethyl-5,5′-dichlorobenzimidazolo oxacarbocyanine hydroxide and 1-ethyl-5-[β-(3-γ-sulfopropyl-2-benzoxazolidene)-ethylidene]-3-ethyl-2-thio-2,4-imidazolidine sodium salt.

* * * * *